US006125808A

United States Patent [19]

Timewell

[11] Patent Number: 6,125,808

[45] Date of Patent: Oct. 3, 2000

[54] APPARATUS AND METHOD FOR STARTING AN INTERNAL COMBUSTION ENGINE

[76] Inventor: Richard R. Timewell, 839 S. Dyke Road, New Westminister British Columbia, Canada, V3M 6L6

[21] Appl. No.: 09/285,889

[22] Filed: Apr. 7, 1999

[51] Int. Cl.[7] ..... F02N 11/00

[52] U.S. Cl. ..... 123/179.5; 123/179.31

[58] Field of Search ..... 123/179.5, 179.1, 123/179.31

[56] References Cited

U.S. PATENT DOCUMENTS

| | | | |
|---|---|---|---|
| 3,626,918 | 12/1971 | Brenneke | 123/179.31 |
| 4,112,895 | 9/1978 | Habert | 123/146.5 |
| 4,462,348 | 7/1984 | Giardini | 123/179.5 |
| 4,635,595 | 1/1987 | Grabbe | 123/179.31 |
| 4,694,799 | 9/1987 | Yagi et al. | 123/425 |
| 5,074,264 | 12/1991 | Emerson | 123/179.3 |
| 5,219,397 | 6/1993 | Jones | 123/179.3 |
| 5,687,682 | 11/1997 | Rambold et al. | 123/179.5 |
| 6,050,231 | 4/2000 | Tisch et al. | 123/179.1 |

FOREIGN PATENT DOCUMENTS 31 17 144 A1 11/1982 Germany .

*Primary Examiner*—Henry C. Yuen
*Assistant Examiner*—Arnold Castro
*Attorney, Agent, or Firm*—Jensen & Puntigam, P.S.

[57] ABSTRACT

An internal combustion engine has a plurality of engine cylinders with pistons which have a path of revolution therein. The one piston which is past a top dead center of its revolution at the beginning of the starting process is identified. Compressed air, at approximately 70 lb. pressure, is injected into the cylinder of that piston, forcing the piston to move such that the next piston in the firing order comes to past a top dead center position. At the same time, an ignition pulse is applied to the cylinder of the one piston for igniting any fuel which may be left in the cylinder and, in addition, fuel is injected into the fourth cylinder in the firing order from said cylinder with the one piston. This occurs for successive pistons until the engine starts.

15 Claims, 5 Drawing Sheets

APPARATUS AND METHOD FOR STARTING AN INTERNAL COMBUSTION ENGINE

TECHNICAL FIELD

This invention relates generally to internal combustion engines for automobiles, and more particularly concerns an apparatus for starting such an engine.

BACKGROUND OF THE INVENTION

Conventional internal combustion engines, such as used in automobiles, require an electric starter motor and a battery capable of delivering high power, particularly during starting operations. This battery capability is sometimes referred to as high cranking current or amps (approximately 200–600 amperes in normal starting operations). The combination of the battery and starter motor must be capable of turning (cranking) an automobile engine at a fairly high speed, approximately 50 rpm, to accomplish conventional starting. Such a conventional system places significant operational demands on both the starter motor and the battery.

Following starting, the demand on the battery is considerably less. Typically, the heavy duty starter motor and the associated conventional battery are expensive. The battery also must be replaced at regular intervals. It is also well known that starting operations produce wear on conventional automatic engines. Typically, several revolutions of the automobile engine, approximately at least three, are required before a conventional engine starts in normal operation. Engine wear results because during the starting process, lubrication is less than during normal engine operation.

Hence, it is desirable to be able to start an internal combustion engine without the necessity of a starter motor and a conventional automobile battery. Further, it is desirable to be able to start the engine within one or two revolutions thereof, thereby saving wear on the engine.

DISCLOSURE OF THE INVENTION

Accordingly, the present invention is an apparatus and corresponding method for starting an internal combustion engine having a plurality of cylinders with pistons moving through a path of revolution, comprising: a system for identifying the one piston from among the plurality of pistons which is past, i.e. over, a top dead center position of revolution in the engine at the beginning of the starting process, wherein the next piston in the firing order from the one piston is positioned before top dead center; a system for injecting compressed air into the cylinder of said one piston, forcing that piston to move sufficiently along its path of revolution that the next piston in the firing order comes to over a top dead center position; a system for igniting the fuel/air combination in the cylinder of said one piston; and a system for injecting fuel into the cylinder which is on its intake stroke following the one piston, wherein the injection of compressed air, the operation of the ignition system and the operation of the fuel injection system occur substantially simultaneously and wherein said compressed air injection system and said ignition means operate on successive cylinders in the firing order of the engine following said one piston and wherein said fuel injection system operates on successive cylinders in the firing order which are on the intake stroke, until the engine starts.

BEST MODE FOR CARRYING OUT THE INVENTION

Figure 1:
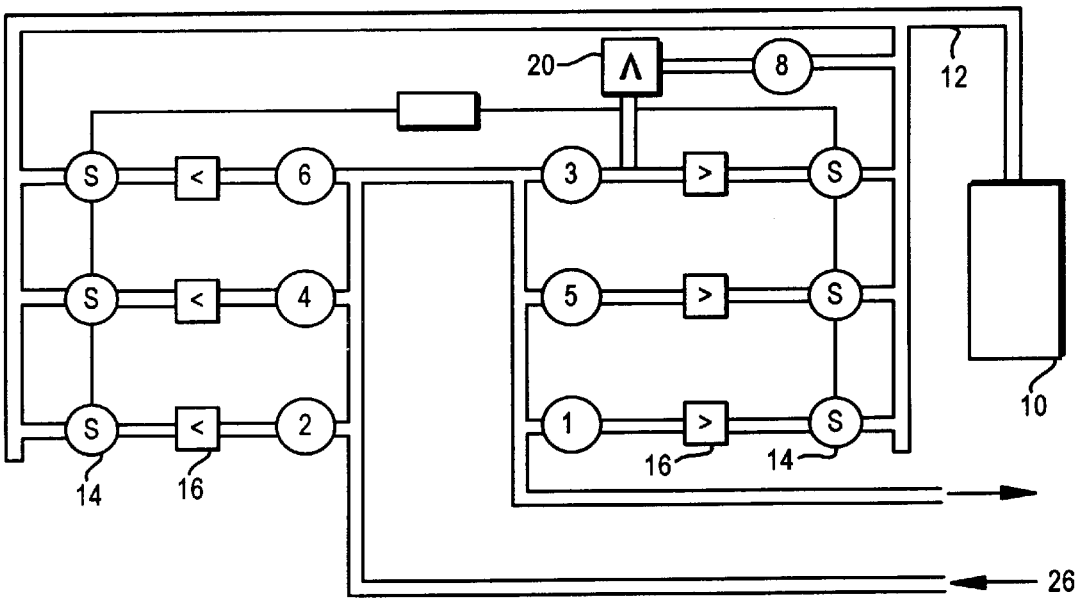
FIG. 1 is a diagram showing the flow of compressed air from a source thereof on board a vehicle to each of the cylinders in a six-cylinder engine.

The present invention is a starting system for use with internal combustion engines, for example, a six-cylinder automobile engine. While a six-cylinder automobile engine is the basis for describing the present invention herein, it should be understood that the system of the present invention is applicable to other internal combustion engine configurations, including those with different numbers of cylinders. The present system is designed to replace the starter motor and conventional battery of existing automobile starting systems. Automobiles using the present invention will still have a battery with a charging system (such as an alternator) for powering the conventional operational electrical system of an automobile, but the battery need not have the high ampere capability that conventional automobile starting systems now require.

In a conventional 6-cylinder engine, there is a particular firing order for the cylinders, namely, one, six, five, four, three, two. The conventional engine includes a system for obtaining, mixing and injecting fuel and air, in a prescribed mixture, into the cylinders of the engine in the order prescribed. Spark plugs are located at the top of each cylinder are ignited at the proper time in the proper firing order. Today's conventional automobile engine also includes microprocessor control of the operation of the engine, including control of the injection of fuel and the ignition of the fuel at the proper time in the various cylinders.

An important aspect of the present invention is the fast, accurate determination of the "position" of each of the pistons in their path of revolution at a particular time. This is referred to generally as engine position. Such information can be obtained in various ways. Some existing automobile engines are capable of providing engine position information with the required accuracy, while other engines will need to be modified. The present invention also takes advantage of the existing fuel injection and ignition systems present in conventional automobiles. The present invention thus can be used as a modification of existing internal combustion engines, as well as with new engines.

In the operational sequence of the present invention, the position of the engine is first identified when the engine key is moved to the start position, in particular the identification of the one particular piston which is just over (beyond) a top dead center (TDC) position. This could of course be any one of the pistons in the engine, as the engine stops at random positions.

Compressed air is injected into that cylinder and an ignition pulse is provided to the spark plug in that cylinder. The first TDC piston is moved sufficiently by the compressed air to move the next piston in the firing order to just over a TDC position. At the same time, fuel is injected into the particular cylinder on the intake stroke, which for a six-cylinder engine is the fourth cylinder in the firing order from the one at the TDC position. If there is some fuel left in the first top dead center cylinder, then it will be ignited by the ignition pulse and the engine will start.

If the engine does not start, and the key is held in its start position, then the injection of compressed air and an ignition pulse is provided to the next cylinder in the firing order (which is now at a TDC position), and fuel is injected into the fifth cylinder (the cylinder now on the intake stroke). The same steps are carried out thereafter for the third and sixth cylinders, and then the fourth and first cylinders (in a six-cylinder engine). The engine will typically always start when the fourth cylinder is at the TDC position (the cylinder at the intake stroke when the first TDC piston is identified), since sufficient fuel is for certain in that cylinder for ignition. The result is that the engine is conveniently and reliably started, typically within one complete revolution of the engine, using only a system of compressed air along with the normal ignition and fuel injection systems and the electrical control requirements therefor, instead of the combination of a separate, high torque starter motor and a heavy-duty conventional battery.

FIG. 1 shows a simplified diagram of the flow of compressed air and fuel for the system of the present invention for a V-6 engine. The firing order of the cylinders is shown in FIG. 1, which determines the order in which compressed air is injected into the engine cylinders. An on-board source of compressed air is shown generally at 10. The source of compressed air 10 is connected to the individual cylinders through a feed line shown generally at 12, which splits into two branches for the two banks of three cylinders. Feed line 12 is connected to each one of the cylinders through separate solenoid 14 and check valve 16 combinations. From each check valve/solenoid combination the feed line connects to each cylinder through a small opening in the cylinder, typically near the spark plug opening, in the vicinity of the top of the cylinder.

In the embodiment shown, feed line 12 is made from steel tubing material and is approximately ⅜ inch in diameter. Alternatively, the feed line could be machined into the engine block. The opening for the compressed air into the top of the cylinder is approximately ¼ inch in diameter in the embodiment shown. Compressed air solenoids 14—14 for the cylinders are opened in a particular order, beginning with the cylinder having the piston which is determined to be just over (usually at 2°–3°) top dead center position at the beginning of the starting operation. The control circuit for the compressed air solenoids 14—14 is discussed below. In the embodiment shown, the compressed air is at a pressure within a range of 70–100 psi, preferably approximately 70 psi, although this can be varied depending upon the particular application.

FIG. 1 also shows a "bleed line" connection 20, which includes a check valve and a solenoid, from a selected one of the cylinders back to the source of compressed air 10. In the embodiment shown, this bleed line is ¼ inch steel tubing. During normal operation of the engine, compressed air source 10 is recompressed by air moving through bleed line 20. Typically, it will take about 50 seconds to recompress. Recompression can also be supplied by a small compressor, or it could be done by hand if necessary.

FIG. 1 also shows in simplified form the fuel injection path, beginning at 26, into each of the cylinders. Fuel injection is accomplished with the existing fuel injectors for the engine, although in the embodiment shown, they are controlled in the particular sequence discussed above during starting procedures. The control over fuel injection is discussed in more detail below.

In operation of the present invention as discussed above, it is necessary to determine the particular piston in the engine which is just over a top dead center position at the beginning of the starting operation. As mentioned above, some conventional automobiles have on-board devices which can provide the required information concerning the identity of the particular engine piston which is just over the top dead center position when the engine switch is turned to the start position.

Figure 2:
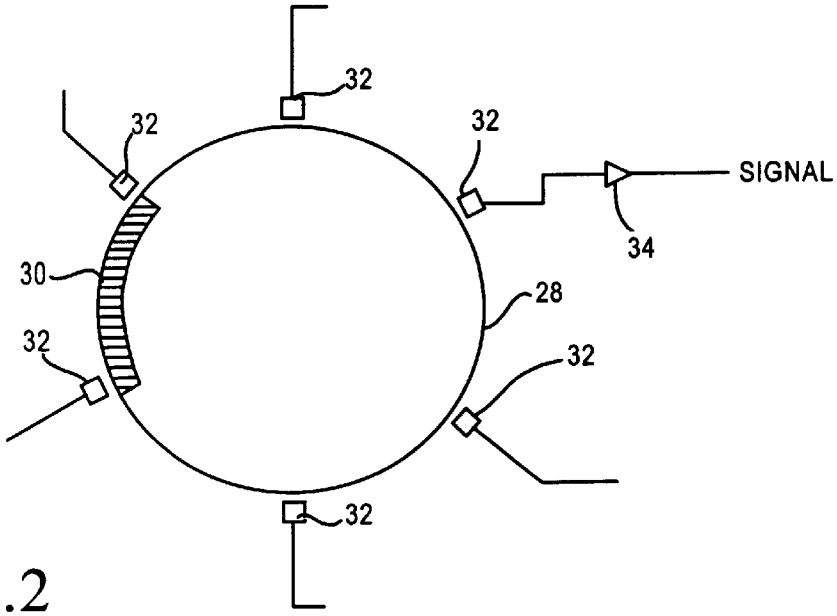
FIG. 2 is a simplified diagram of an engine position sensor used in the engine startup system of the present invention.

In the present embodiment, a separate system for determining the just past top dead center position of the pistons is provided. Referring to FIG. 2, a disc 28 is secured to the rear end of the engine camshaft, which extends out the rear of the engine. On the edge of the disc, covering approximately 63° (greater than 60°), is a magnetic element 30. Positioned around the periphery of the disc but spaced slightly away therefrom are six Hall effect transistors 32—32, at 60° intervals. The magnet element 30 is arranged relative to the position of the Hall effect transistors such that outputs from each amplifier associated with each transistor in turn represents when an associated piston has just passed the top dead center position. It should be understood, however, that other ways of obtaining such top dead center piston information are possible.

The engine position sensor is thus capable of determining the particular piston that has gone just past the top dead center position, at the end of its compression stroke. This piston must be past top dead center, so that the injection of compressed air can move the piston along its path of revolution, bringing the next piston in the firing order up to a point of being over top dead center. The position of the first piston identified must be over top dead center, but could be a considerable amount over (up to almost 60°), as long as the next piston in the firing order is not over top dead center. Typically, when the engine stops, one of the pistons will be just over top dead center. The information concerning piston position is available both when the engine is stopped, i.e. waiting to be started, and when the engine is going through its starting procedure.

Figure 3:
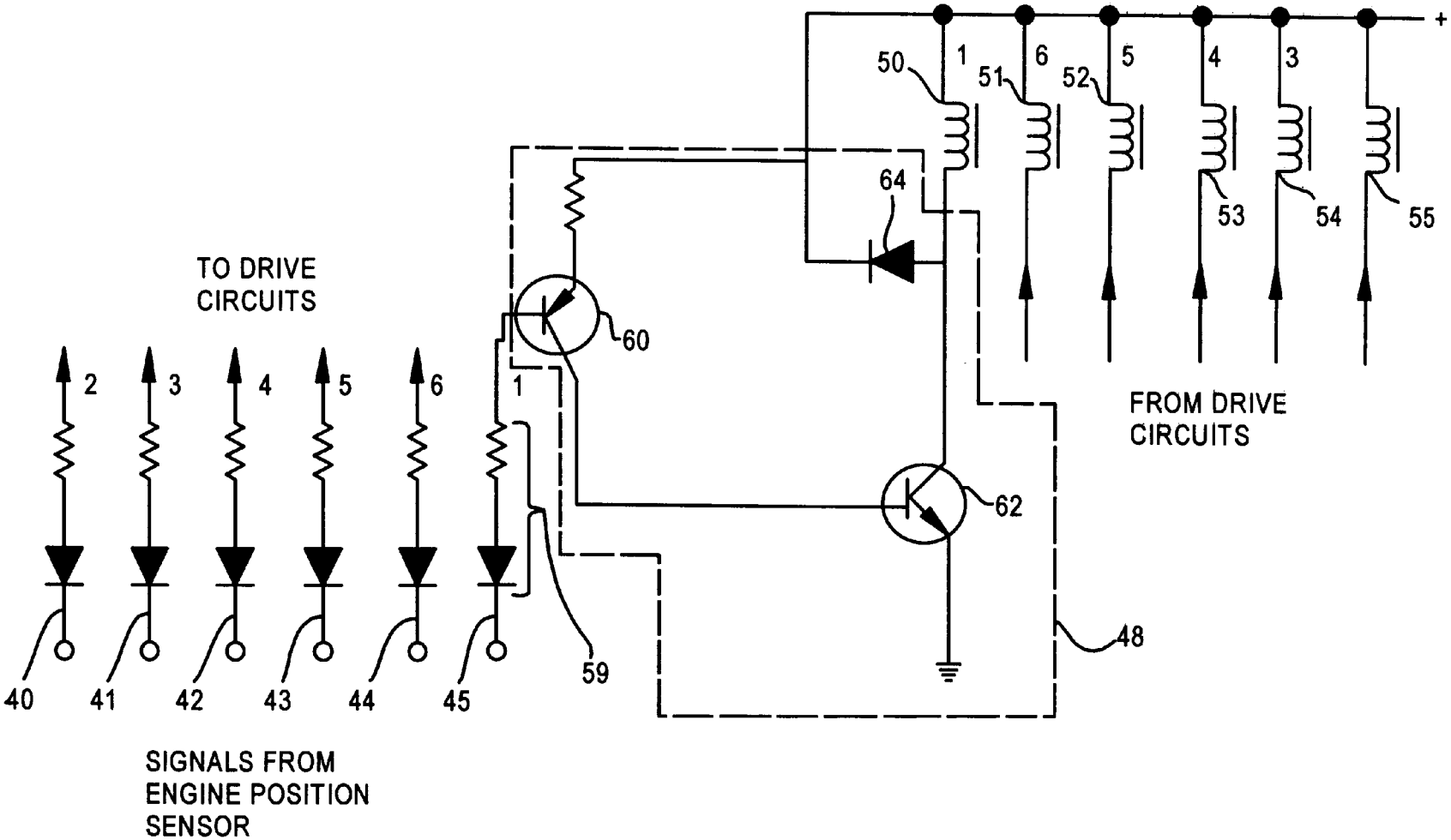
FIG. 3 is a diagram showing the control of the injection of compressed air into each of the cylinders of the engine of FIG. 1.

FIG. 3 shows the control circuit for the compressed air solenoids. The six signals from the engine position sensor are applied to input lines 40–45. The output of the compressed air control circuit is applied to control solenoids 50–55, which are the solenoids shown in FIG. 1 associated with each cylinder. For simplicity of explanation, only one complete circuit is shown, i.e. the circuit 48 between input line 45 (cylinder number one) and solenoid 50 (cylinder number four in the firing order). Each engine position signal is associated with a particular solenoid. Each engine position signal is applied to an input line circuit comprising a combination 59 of a diode and a resistor. The output thereof is applied to one control circuit 48, which includes transistors 60 and 62, with a protective diode 64. Basically, when an engine position sensor signal indicates that a particular piston is over top dead center, i.e. a signal on line 45 for piston number one, the output of the control circuit 48 opens solenoid 50 for that particular cylinder. This results in an application of compressed air into cylinder number one, as shown in FIG. 1.

The injection of compressed air moves piston number one along its path of revolution for approximately one-sixth of its cycle. Solenoid 50 is open long enough that the next piston in the firing order is moved to just over (past) top dead center position. These actions occur for each solenoid in turn until the engine starts. In the embodiment shown, each solenoid is controlled to be open for approximately ⅓ revolution, typically 1 second.

Figure 4:
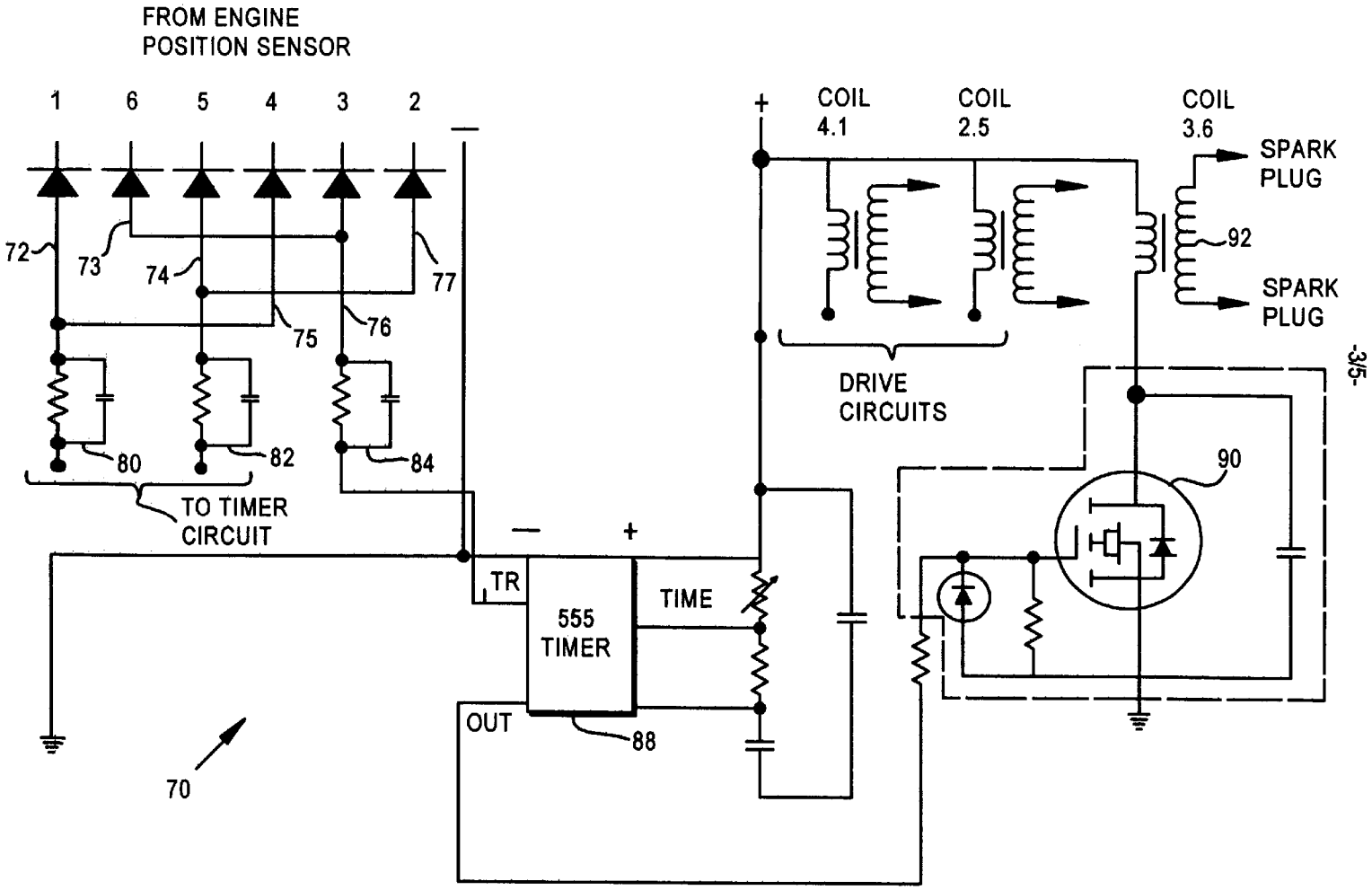
FIG. 4 is a diagram showing the ignition circuit of the engine startup system of the present invention.

FIG. 4 shows one of three ignition control circuit used in the present invention, with each ignition circuit controlling the ignition of two cylinders. The ignition control circuit is shown generally at 70. Again, the signals from the engine position sensor come in on input lines 72–77, each line having a diode therein. The input lines connect to three pulse generator circuits, each pulse generator circuit comprising a parallel connection of a 100K resistor and a 1 $\mu$f capacitor in the embodiment shown.

Pulse generator 80 is connected to engine position lines for cylinders one and four; pulse generator 82 is for cylinders two and five; pulse generator 84 is for cylinders three and six. In the one ignition circuit shown, the signal from pulse generator 84 is sent to a timer 88, the output of which establishes the length of the ignition pulse to the ignition coils. In the embodiment shown, timer 80 is a well-known 555 timer made by Intercel. The output signal from timer 88 is applied to a drive circuit 89 which includes a MOSFET power transistor 90, which produces a firing pulse. The firing pulse, in turn, is directed to coil 92, the opposing ends of which are connected to the spark plugs for cylinders six and three, respectively, for ignition of the gases in those cylinders at the prescribed time. Similar control circuits are provided for the coils for cylinders one and four and cylinders two and five. Again, the ignition pulses are provided to the cylinders in sequence based on the over top dead center piston.

Figure 5:
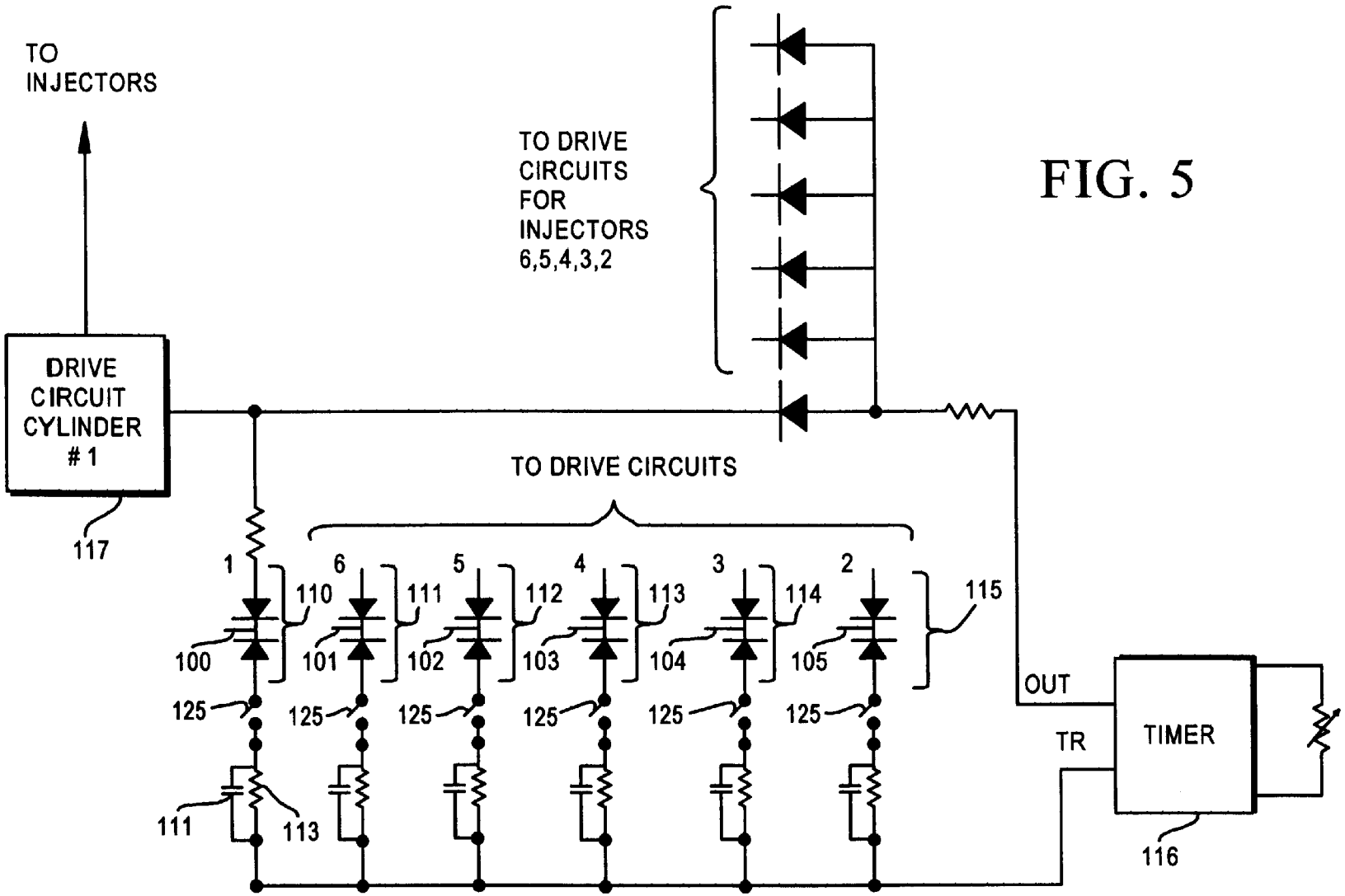
FIG. 5 is a diagram showing the control of the injection of fuel into the cylinders in the engine of FIG. 1.

FIG. 5 shows the drive circuit for the injection of fuel into the cylinders. As with the other circuits, input signal lines from the engine sensor circuit are shown at 100–105. These signals are applied, respectively, to a series of back-to-back diode connections 110–115. One diode in each combination is connected to a series combination of a 100K resistor and a 33 $\mu$f capacitor (113 and 111 for cylinder one) and then to the input of a 555 timer 116. The output of timer 116 and the signal from the other diode in each diode combination 110–115 control the sequence of and the "on" time of each fuel injector through drive circuits, one drive circuit 117 being shown for cylinder one, for example.

Figure 6:
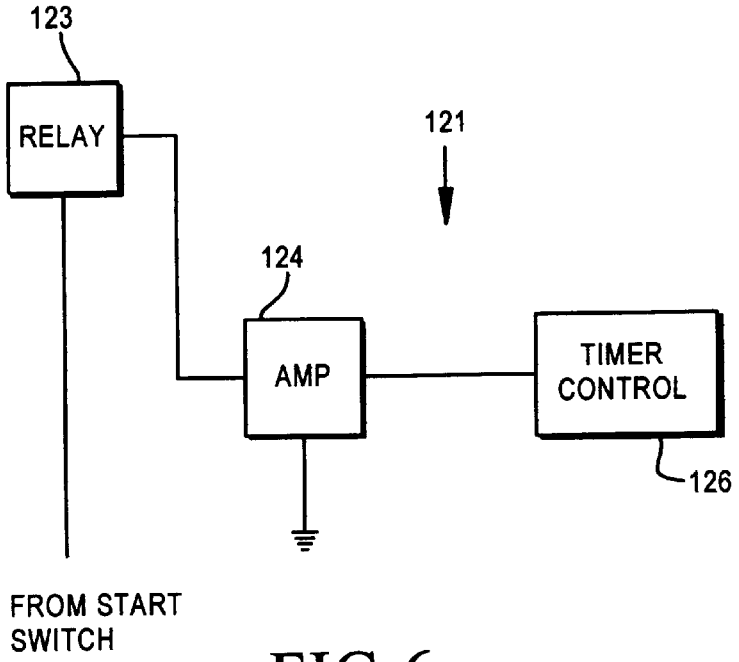
FIG. 6 is a diagram showing a circuit which controls the length of time of operation of the fuel injection portion of the engine starting system of the present invention.

FIG. 6 shows, generally at 121, a "shut off" circuit for the fuel injector control circuit of FIG. 5. The starting system of the present invention as a whole is shut off when the engine has started and the start switch is released from the start position, as with conventional starting systems. The engine's conventional operating and control systems then take over. The two systems hence do not operate simultaneously. In the starting system, the signal from the engine starting switch is applied through a relay 123, with the signal being amplified by amplifier 124 to initiate operation of the fuel injector drive circuits through switches 125—125. Timer 126 establishes the time of operation of the fuel injector drive circuit. This time is adjustable. Once the time has expired, the relay 123 will open the switches 125 and the fuel injectors will cease operation for that starting attempt.

Figure 7:
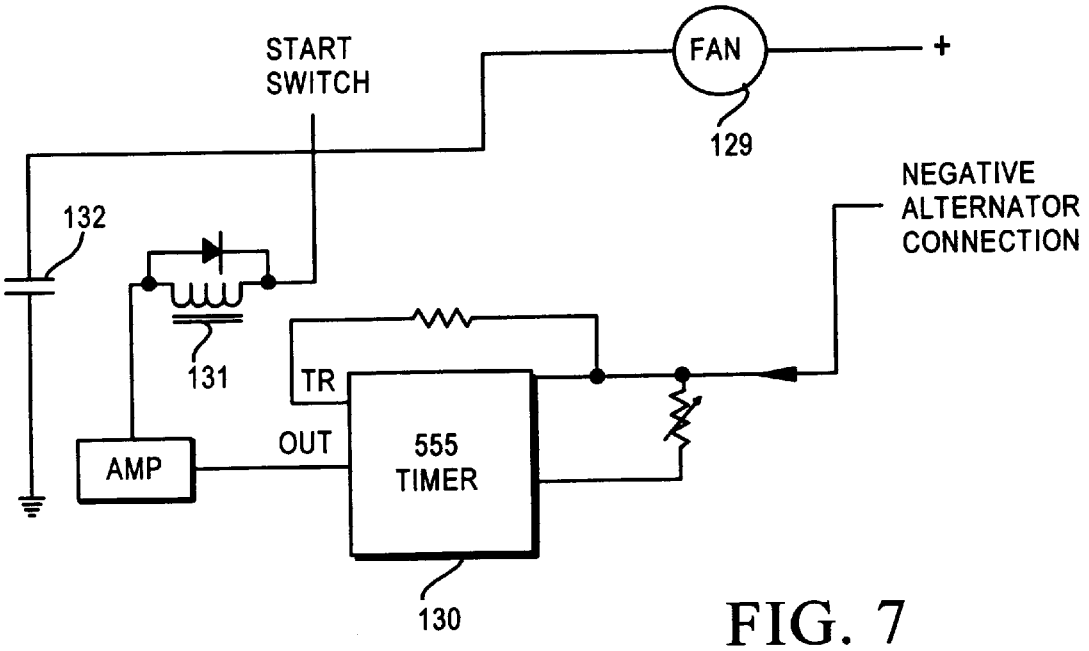
FIG. 7 is a diagram showing a fan delay circuit for the engine starting system of the present invention.

FIG. 7 shows a fan time delay circuit. It is typically not desirable for the engine fan 129 to be operating during startup of the engine. Hence, a timer 130 is provided which holds relay 131 open, which in turn maintains fan contacts 132 open, so that fan 130 does not operate. Further, input from the negative side of the engine alternator prevents the fan from operating until the alternator begins to charge. Hence, the fan will not turn on until the timer's set time has gone by and the alternator begins to charge. The timer can be charged by variable resistor 135. Typically, the time of timer 30 is 10 seconds. Usually, it also takes approximately two seconds (time) for the alternator to be in a charging condition. The fan delay circuit, while having some benefit, is, however, not essential for the operation of the invention.

As indicated above, the individual circuits described herein are only one particular embodiment of the starting system of the present invention. Other comparable circuits can be designed and in some cases structural elements, circuitry and microprocessor control functions present in existing automobiles can be used. The compressed air assembly and control, however, must be added to the conventional automobile engine in order to achieve the starting procedure of the present invention.

In summary, the present invention is an apparatus and method for starting an internal combustion engine without the requirement of a starter motor and a conventional automobile battery. The present invention uses a combination of injection of compressed air with a particular sequence of ignition and injection of fuel into the engine cylinders.

The present invention is typically capable of starting the engine within one revolution, which results in substantially less wear on the engine during engine startup.

Although a preferred embodiment of the invention has been disclosed herein for illustration, it should be understood that various changes, modifications and substitutions may be incorporated in such embodiment without departing from the spirit of the invention, which is defined by the claims as follows.

What is claimed is:

1. An apparatus for starting an internal combustion engine having a plurality of cylinders with pistons moving through a path of revolution therein, comprising:

means for identifying the one piston in the plurality of pistons which is past a top dead center position of revolution in the internal combustion engine at the beginning of starting of the engine, wherein the next piston in the firing order from the one piston is positioned before its top dead center position;

means for injecting compressed air into the cylinder of said one piston, forcing the piston to move sufficiently along its path of revolution that the next piston in the firing order comes to past a top dead center position;

ignition for means for igniting the fuel/air combination in the cylinder of said one piston; and means for injecting fuel into the cylinder, following the one piston, which is on its intake stroke, wherein the injection of compressed air, the operation of the ignition means, and the operation of the fuel injection means occur substantially simultaneously, and wherein said compressed air injection means and said ignition means operate on successive cylinders in the firing order of the engine following said one piston and wherein said fuel injection means operates on successive cylinders in the firing order, following the one piston, which are on the intake stroke, until the engine starts.

2. An apparatus of claim 1, wherein the starting apparatus is characterized by lack of a starting motor and a conventional automobile battery.

3. An apparatus of claim 1, wherein the compressed air injection means includes a single solenoid control assembly, having multiple ports, one for each cylinder in the engine.

4. An apparatus of claim 1, wherein the compressed air injection means includes a plurality of solenoid control devices, one for each cylinder in the engine.

5. An apparatus of claim 1, including means connecting at least one of the cylinders in the engine back to the source of compressed air for recompression of said source during normal operation of the engine.

6. An apparatus of claim 5, wherein recompression occurs for approximately 50 seconds.

7. An apparatus of claim 5, wherein the compressed air is at a pressure within the range of 70–100 psi.

8. An apparatus of claim 1, including means for preventing operation of a fan portion of the engine until a selected amount of time has gone by following initiation of the starting apparatus and an indication that an alternator portion of the engine has begun charging.

9. An apparatus of claim 8, including means for controlling the amount of time compressed air is injected into each cylinder in turn.

10. An apparatus of claim 1, wherein compressed air is injected for approximately one-third of a revolution of the one piston.

11. An apparatus of claim 1, including means for terminating the operation of the fuel injection system a selected amount of time following initiation of a start switch on the engine.

12. An apparatus of claim 11, wherein the selected time is approximately two seconds.

13. A method for starting an internal combustion engine having a plurality of cylinders with pistons moving through a path of revolution therein, comprising the steps of:

identifying the one piston in the plurality of pistons which is past a top dead center position of revolution in the internal combustion engine at the beginning of starting of the engine, wherein the next piston in the firing order from the one piston is positioned before its top dead center position;

injecting compressed air into the cylinder of said one piston, forcing the piston to move sufficiently along its path of revolution that the next piston in the firing order comes to past a top dead center position;

igniting the fuel/air combination in the cylinder of said one piston; and injecting fuel into the cylinder, following the one piston, which is in its intake stroke, wherein the injection of compressed air step, the ignition step and the fuel injecting step occur substantially simultaneously, and wherein the injection of compressed air and said ignition step are used on successive cylinders in the firing order of the engine following said one piston, and wherein said fuel injection step is used on successive cylinders in the firing order, following the one piston, which is on its intake stroke, until the engine starts.

14. A method of claim 13, including the step of connecting at least one of other cylinders in the engine back to the source of compressed air for recompression of said source during normal operation of the engine.

15. A method of claim 13, wherein the compressed air is at a pressure within the range of 70–100 psi.

* * * * *